US006267169B1

(12) United States Patent
McDonald

(10) Patent No.: US 6,267,169 B1
(45) Date of Patent: Jul. 31, 2001

(54) VERTICALLY FOLDING WALL PARTITIONS

(75) Inventor: J. Mark McDonald, Beaconsfield (CA)

(73) Assignee: Railtech Ltd., Baie d'Urfe (CA)

( * ) Notice: Subject to any disclaimer, the term of this patent is extended or adjusted under 35 U.S.C. 154(b) by 0 days.

(21) Appl. No.: 09/513,457

(22) Filed: Mar. 3, 2000

(51) Int. Cl.[7] ..... E05F 15/00
(52) U.S. Cl. ..... 160/193; 160/84.08; 160/218
(58) Field of Search ..... 160/188, 193, 160/207, 218, 40, 84.08

(56) References Cited

U.S. PATENT DOCUMENTS 3,344,837 * 10/1967 Young ..... 160/207
4,027,714 * 6/1977 Dixon et al. ..... 160/84.08
4,303,117 * 12/1981 Lindbergh ..... 160/207
4,724,884 * 2/1988 Weem ..... 160/84.08
4,763,712 * 8/1988 Van Der Klaauw ..... 160/84.08
4,867,221 * 9/1989 Dixon et al. ..... 160/84.08
5,062,464 11/1991 Peterson .

FOREIGN PATENT DOCUMENTS

549404 * 11/1957 (CA) ..... 160/193

* cited by examiner

*Primary Examiner*—Blair M. Johnson
(74) *Attorney, Agent, or Firm*—Foley & Lardner

(57) ABSTRACT

A vertically foldable wall partition comprises a plurality of panels mounted to a number of horizontally spaced-apart vertically foldable skeleton framework. Each skeleton framework includes a number of pivotally interconnected arms which are adapted to be successively folded in a predetermined sequence. The sequential folding is controlled by a lifting mechanism. The vertically foldable wall partition further includes a universal sealing member which can be either used as an end seal or as a hinge seal.

12 Claims, 9 Drawing Sheets

44c
54c 48c
45c
44c
50c
84
26
26
46c
38
41
40
94
52c
37
72c
46c
38
39
102

VERTICALLY FOLDING WALL PARTITIONS

BACKGROUND OF THE INVENTION

1. Field of the Invention

The present invention relates to operable wall partitions and, more particularly, to such operable wall partitions which are vertically movable between raised and lowered positions.

2. Description of the Prior Art

It is well known to use movable wall partitions to selectively divide interior building spaces, such as conference room, halls and school gymnasium, into smaller interior spaces.

Currently available operable wall partitions are typically formed of vertically extending wall panels or curtains slidably mounted at an upper end thereof in horizontal overhead tracks or rails fixed to an overhead structure of a building. Because such horizontally displaceable wall partitions slide from one end of the tracks to the other end thereof, the loads on the overhead structure of the building are not evenly distributed, especially when they are displaced to a storage position. In some cases, this can cause deflection problems as well as highly concentrated loading problems. Furthermore, horizontally movable wall partitions requires extra storage space for the partition in the plan area of the building.

In an attempt to overcome the above mentioned drawbacks, it has been proposed to replace conventional horizontally slidable wall partitions by vertically folding wall partitions. Such a vertically folding wall partition system is disclosed in U.S. Pat. No. 5,062,464 issued on Nov. 5, 1991 to Peterson. More specifically, this patent discloses a vertically folding wall partition system comprising a plurality of arm support panels pivotally mounted in series on either side of a vertically contractible/expandable pantograph skeleton framework hanging from an overhead structure in the central plane of the wall partition. Each arm support panel includes a pair of elongated arm segments pivotally connected to each other via a hinge moving towards and away from the plane of the pantograph skeleton framework in response to vertical movements of the point of attachment of the arm support panel with the skeleton framework. The provision of the skeleton framework causes all the arm support panels to fold and unfold simultaneously.

Although the vertical folding wall partition described in the above mentioned patent is effective, it has been found that there is a need for a new and simplified vertically folding wall partition which is adapted to fold in a predetermined sequence in order to prevent the bottom panels of the wall partition to interfere with objects placed near the wall partition, as the panels move outwardly away of the plane of the wall towards the collapsed, folded position thereof.

SUMMARY OF THE INVENTION

It is therefore an aim of the present invention to provide a vertically folding wall partition which is adapted to fold in a predetermined sequence.

It is also an aim of the present invention to provide a vertically folding wall partition system having improved safety features.

It is a further aim of the present invention to provide a new method of operating a vertically folding wall partition.

It is a still further aim of the present invention to provide a sealing member which can be used either as an end seal or a hinge seal.

Therefore, in accordance with the present invention there is provided a vertically folding wall partition comprising a vertical series of similar panel assemblies. The wall partition is pivotally connected at an uppermost edge thereof to an overhead support structure for rotation about a horizontal axis. Successive panel assemblies in the vertical series are pivotally connected to each other by a horizontal joint for allowing relative pivotal movement therebetween. Each panel assembly includes top and bottom panels pivotally related to one another at opposed horizontal edges thereof for pivotal movement between an unfolded position in which the top and bottom panels extend substantially in a common vertical plane and a folded position in which the top and bottom panels extend laterally outwardly of their common vertical plane in an opposed surface-to-surface stacked relationship. A moving mechanism is provided for displacing the vertically folding wall partition between a retracted raised, storage position and a deployed, unfolded, wall-forming position. The moving mechanism is operatively connected to at least a selected one of the joints and to a bottom end of a lowermost panel assembly of the vertical series to successively fold the panel assemblies in a folding sequence starting with the first panel assembly located above the selected joint.

In accordance with a more specific aspect of the present invention, the moving mechanism includes a first lifting arrangement operable to displace the selected joint vertically upwardly to cause the first panel assembly located thereabove to fold independently of the lowermost panel assembly. A second lifting arrangement is operable to displace the bottom end of the lowermost panel assembly vertically upwardly to cause the same to fold once the first panel assembly has been displaced to the folded position thereof.

In accordance with a further general aspect of the present invention, there is provided a convertible sealing member adapted to be used in a folding wall partition having a plurality of pivotally interconnected panels with successive panels having confronting edges. The sealing member comprises a resilient piece of material having first and second opposed longitudinal surfaces extending between opposed longitudinal side edges and opposed end edges. The flexible piece of material has opposed side portions extending inwardly from the opposed longitudinal side edges at an acute angle to the first longitudinal surface. The resilient piece of material is selectively usable as an intermediate seal member wherein the opposed side portions are secured to the confronting edges of a pair of adjacent panels, and as an end seal wherein the opposed side portions are brought together in opposed surface-to-surface relationship to form an anchor for securing the resilient piece of material to a distal end of a terminal panel of the folding wall partition.

In accordance with another general aspect of the present invention, there is provided a method of lifting a wall partition composed of a series of vertically foldable paired wall segments, the series having a lowermost paired wall segments. The method comprises the steps of: lifting the lowermost paired wall segments by folding at least another selected one of the vertically foldable paired wall segments from an extended position to a collapse position thereof, and subsequently folding the lowermost paired wall segments to a collapse position thereof.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
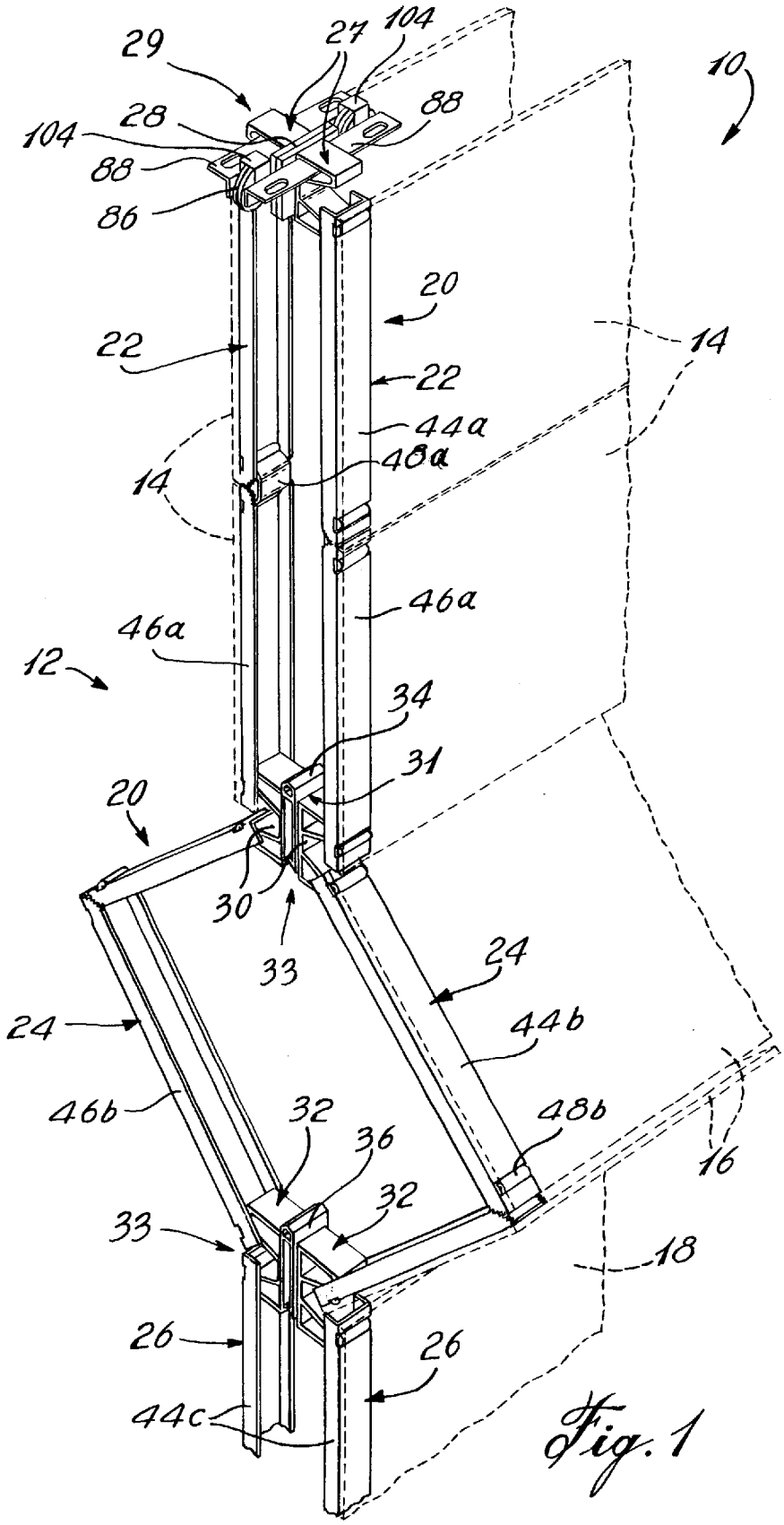
FIG. 1 is a fragmentary simplified perspective view of a left hand side of a vertically folding wall partition illustrated in the process of being moved to a retracted raised, folded position in accordance with a first embodiment of the present invention.

Now referring to the drawings, and in particular to FIG. 1, a vertically folding wall partition embodying the elements of the present invention and generally designated by reference numeral 10 will be described.

The vertically folding wall partition 10 is adapted to be mounted to an overhead structure of a building, such as a ceiling structure C (see FIG. 5*a*), for movements between a retracted raised, folded position in which the vertically folding wall partition 10 is stored in the ceiling structure C, and a deployed, unfolded straight, wall-forming position in which the vertically folding wall partition 10 extends vertically downwardly from the ceiling structure C to a support surface, such as a floor F (see FIG. 10), in order to divide an interior building space into two smaller spaces. It is understood that the overall dimensions of the vertically folding wall partition 10 will be such that when it is displaced to its deployed, unfolded straight, wall-forming position, the wall partition 10 will form a unitary flat wall which extends completely across the area to be divided.

According to the illustrated embodiment, the vertically folding wall partition 10 generally comprises a number of similar articulated skeleton frameworks, one of which is designated by reference 12 in FIGS. 1 and 5*a* to 5*c*, depending downwardly from the ceiling structure C at horizontally spaced-apart locations along a line where the operable wall is to be formed. Top, intermediate and bottom pairs of vertically foldable rigid panels 14, 16 and 18 are mounted on either side of the articulated skeleton frameworks to form a double sided wall partition. The panels 14, 16 and 18 are preferably of a rectangular construction and elongated in the horizontal direction.

As seen in FIGS. 1 and 5*a* to 5*c*, the articulated skeleton framework 12 includes two identical sets of serially connected vertically foldable arms 20 which are symmetrically disposed relative to the central plane of the vertically folding wall partition 10. According to the illustrated embodiment, each set 20 includes top, intermediate and bottom vertically foldable arms 22, 24 and 26 on which the top, intermediate and bottom pairs of panels 14, 16 and 18 are respectively secured.

The top vertically foldable arm 22 of each set 20 is pivotally mounted at an upper end thereof to a hanger 27 fixed to the ceiling structure C. The hangers 27 of both sets 20 are mounted on opposed sides of a central spacer 28 to form a unified hanging structure 29 which is symmetrical relative to the central plane of the wall partition 10.

The top and intermediate vertically foldable arms 22 and 24 of a same set 20 are connected to each other via a first inner link 30 pivotally connected at an upper end thereof to a lower end of the top vertically foldable arm 22 and at a lower end thereof to an upper end of the intermediate vertically foldable arm 24.

Similarly, the intermediate and bottom vertically foldable arms 24 and 26 of a same set 20 are connected to each other via a second inner link 32 pivotally connected at an upper end thereof to a lower end of the intermediate vertically foldable arms 24 and at a lower end thereof to an upper end of the bottom vertically foldable arm 26.

Figure 4:
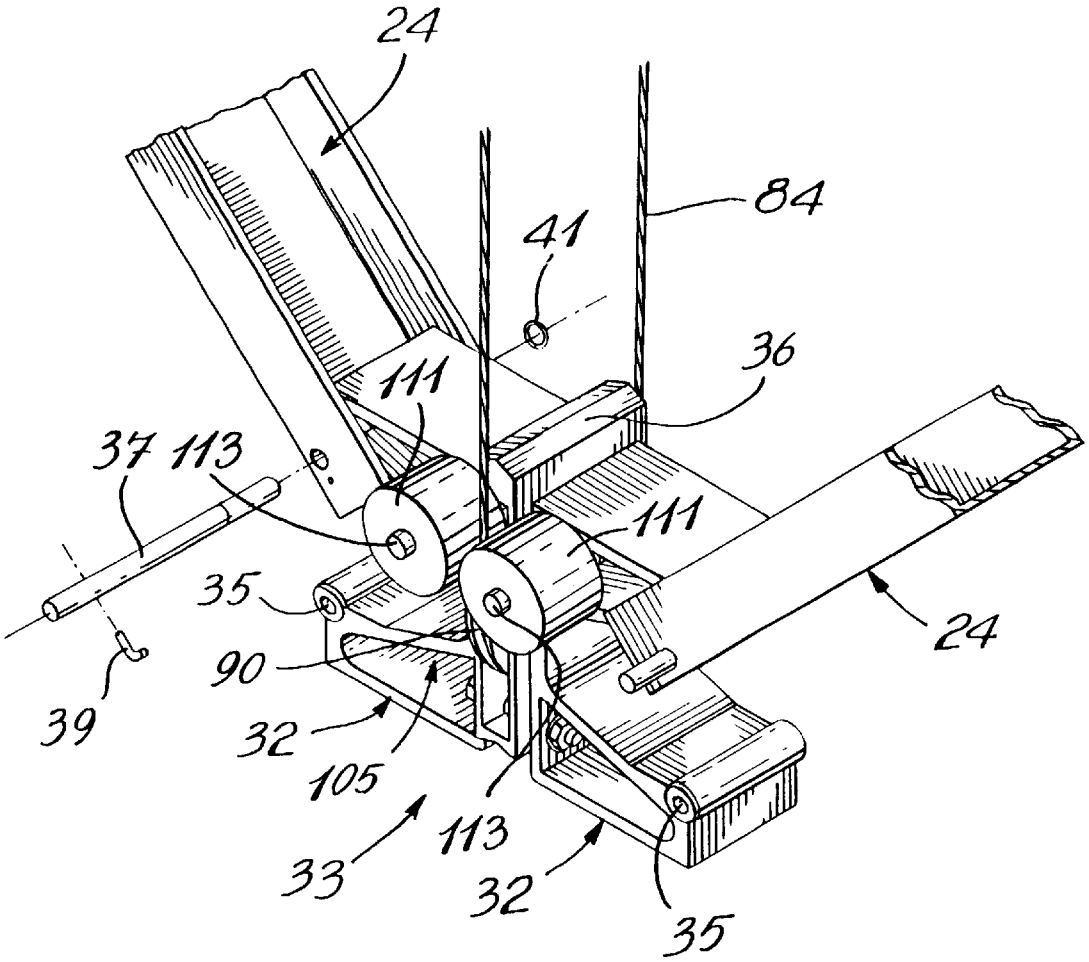
FIG. 4 is an enlarged perspective view of an inner hinge used to pivotally interconnect successive folding arms.

The first inner links 30 are fixedly mounted on opposed sides of a first central hollow pulley guide support 34 to form a first structurally unified linkage 31 which is symmetrical relative to the central plane of the wall partition 10. Similarly, as best seen in FIG. 4, the second inner links 32 are fixedly mounted on opposed sides of a second central hollow pulley guide support 36 to form a second structurally unified linkage 33 which is symmetrical relative to the central plane of the wall partition 10. The first structurally unified linkage 31 will ensure that the top vertically foldable arms 22 disposed on opposed side of the central plane of the wall partition 10 fold and unfold conjointly, while the second structurally unified linkage 33 will ensure that the intermediate folding arms 24 disposed on opposed sides of the wall partition 10 will fold and unfold conjointly. It is noted that the first inner links 30 and the first central hollow pulley guide support 34 are respectively substantially identical to the second inner links 32 and the second central hollow pulley guide support 36, whereby only the structural details of the latter will be herein described with reference to FIG. 4. Each second inner link 32 has a generally C-shaped configuration and defines at opposed free ends thereof a pair of transversal passages 35 adapted to receive associated hinge pins 37 for allowing the intermediate and bottom support arms 24 and 26 to independently pivot relative to the second inner link 32. Conventional retaining pins 39 and retaining rings 41 are provided for preventing axial disengagement of the hinge pins 37.

As seen in FIGS. 2 and 5*a* to 5*c*, the lower end of each bottom vertically foldable arm 26 is pivotally mounted to a bottom inner link 38. The bottom inner links 38 are fixedly mounted on opposed sides of a central bottom hollow guide support 40 to form a structurally unified bottom linkage 42 which is symmetrical relative to the central plane of the wall partition 10. The central bottom hollow guide support 40 of each skeleton framework 12 can be interconnected to each other via bottom beams segments (not shown).

It is understood that the respective pivot points of the hanger 27, the first inner link 30, the second inner link 32 and the bottom inner link 38 of a same set 20 of vertically foldable arms are in vertical alignment at a predetermined distance from the central plane of the wall partition 10. Accordingly, the pivot points of the first inner link 30, the second inner link 32 and the bottom inner link 38 will move vertically in a same plane during operation of the wall partition.

The top, intermediate and bottom vertically foldable arms 22, 24 and 26 are of similar construction and, thus, only the structural features of the top vertically folding arms 22 will be described hereinbelow. The structural features of the intermediate and bottom vertically foldable arms 24 and 26 corresponding to those of the top vertically foldable arms 22 will be designated in the drawings by the reference numerals used for the top vertically foldable arms 22 but with suffixes B and C, respectively.

Figure 3:
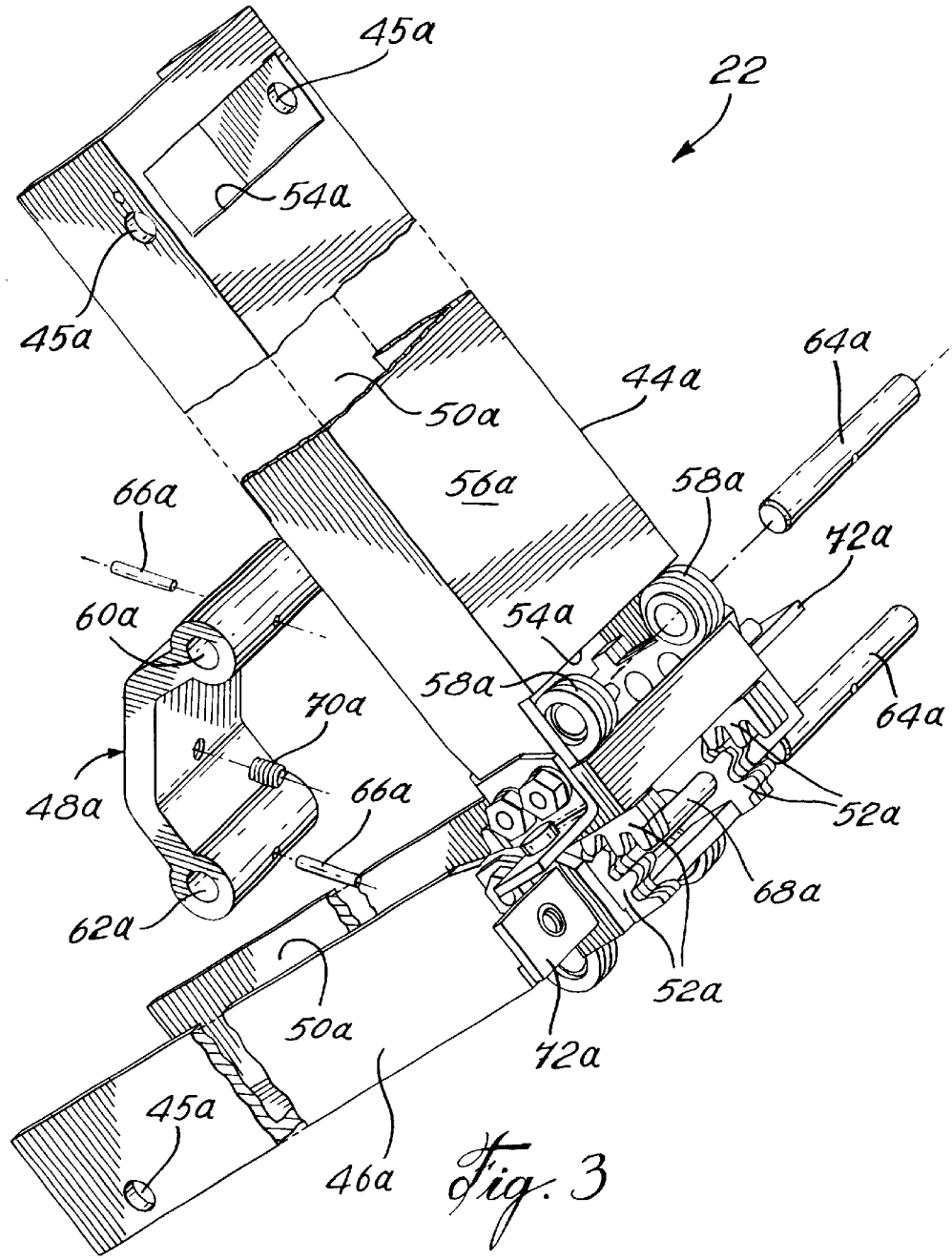
FIG. 3 is a fragmentary enlarged, partly exploded, perspective view of an elbow joining adjacent segments of a vertically folding arm.

Referring now to FIG. 3, it can be seen that the top vertically foldable arm 22 of each set 20 includes a pair of similar elongated arm segments 44*a* and 46*a* pivotally interconnected at adjacent ends by a C-shaped link 48*a* so as to allow the top arm 22 to fold outward away from the plane of the wall partition 10. The other ends of arms segments 44*a* and 46*a*, i.e. the one opposed to the confronting ends thereof, each define a transversal passage 45*a* for receiving a hinge pin (not shown) in order to pivotally secure the arm segments 44*a* and 46*a* to the associated hanger 27 and associated first inner link 30, respectively, as per the way described hereinbefore with respect to second inner links 32 and the intermediate vertically foldable arms 24. The arm segments 44*a* and 46*a* each have a C-shaped cross-section and each define an internal channel 50*a* which is open towards the central plane of the wall partition 10 to receive therein the C-shaped link 48*a*.

Two pairs of cooperating spur gears 52*a* are secured within respective internal channels 50*a* of the arm segments 44*a* and 46*a* at adjacent or confronting ends thereof to ensure that the arm segments 44*a* and 46*a* move outwardly and inwardly at the same rate during contraction and expansion of the wall partition 10.

A rectangular cutout portion 54*a* is defined in the mounting walls 56*a* of the arm segments 44*a* and 46*a* at the confronting ends thereof. A pair of transversally spaced-apart bushings 58*a* extends outwardly of each cutout portion 54*a*. According to a construction of the present invention, the bushings 58*a* can be mounted to the structure of the spur gears 52. The C-shaped link 48*a* defines at opposed ends thereof two cylindrical passages 60*a* and 62*a* which are respectively adapted to be positioned in alignment with the corresponding pairs of transversally spaced-apart bushings 58*a* for receiving respective hinge pins 64*a* therethrough in order to pivotally secure the arm segments 44*a* and 46*a* to the C-shaped link 48*a* at two distinct pivot points. A spring tension pin 66*a* is inserted transversally through each cylindrical passage 60*a*,62*a* to prevent axial removal of the associated hinge pin 64*a*.

A bumper pin 68*a* extends transversally between the spur gears 52*a* of arm segments 46*a*. A set screw 70*a* is threadably engaged with the C-shaped link 48*a* to cooperate with the bumper pin 68*a* to limit inward movements of the confronting ends of the arm segments 44*a* and 46*a* when the wall partition 10 is displaced to its deployed, unfolded straight, wall-forming position.

Angled panel supports 72*a* are mounted on the opposed outer sides of the arm segments 44*a* and 46*a* at the confronting ends thereof to secure the top panels 14 to respective mounting walls 56*a* of the arm segments 44*a* and 46*a*. Accordingly, one of the top panels 14 is secured to the arm segment 44*a* while the other panel 14 is secured to the arm segment 46*a*. The width of each panel 14, in the vertical direction, correspond to the length of the associated arm segment 44*a*, 46*a* to ensure that the wall partition 10 will have a solid, planar, unbroken appearance when the arm segments 44*a* and 46*a* are vertically oriented.

The vertically folding wall partition 10 further includes a lifting mechanism 74 which is adapted to cause the wall partition 10 to fold in a sequence starting with the intermediates vertically folding arms 24, followed by the bottom vertically foldable arms 26 and the top vertically foldable arms 22. The lifting mechanism 74 comprises a motor (not shown) operatively connected to a plurality of sheave and cable assemblies, one of which is designated by reference numeral 76 in FIG. 6. One such sheave and cable assembly is preferably provided for each skeleton framework 12.

Figure 6:
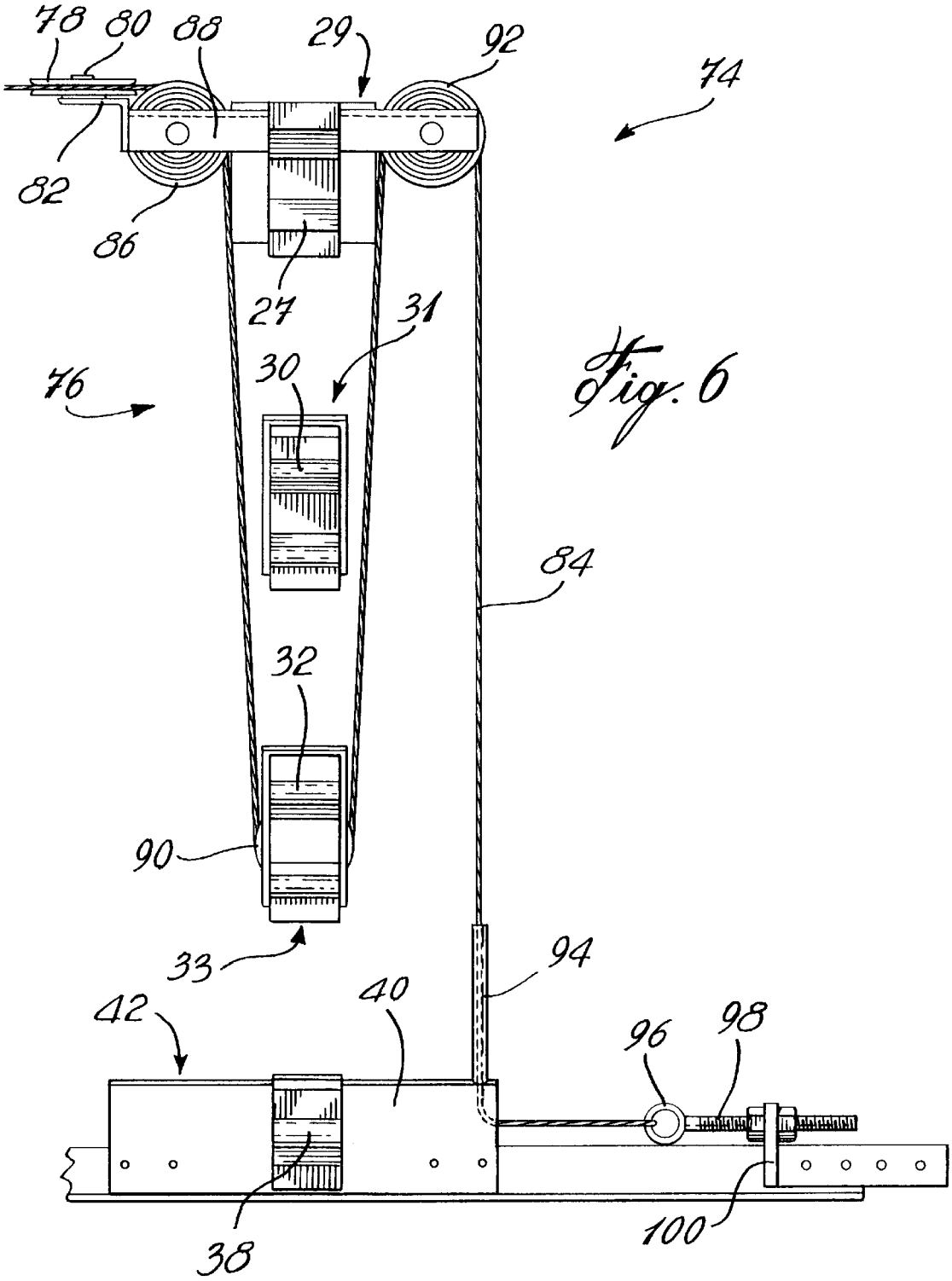
FIG. 6 is a simplified elevational view of a lifting mechanism of the vertically folding wall system of FIG. 1.

As seen in FIG. 6, the sheave and cable assembly 76 includes a first pulley 78 mounted for rotation about a vertical pivot pin 80 extending upwardly from a fixed overhead structure 82 adjacent the unified hanging structure 29. The first pulley 78 guides a cable 84 to a second pulley 86 mounted to the unified hanging structure 29 for rotation about a horizontal axis perpendicular to the central plane of the wall partition 10. More particularly, as seen in FIG. 1, the second pulley 86 is mounted adjacent one end of the central spacer 28 between a pair of angled supports 88 forming part of the unified hanging structure 29. According to the illustrated embodiment, the second pulley 86 is centered relative to the central plane of the wall partition 10. The cable 84 extends over the second pulley 86 down and around a third pulley 90 mounted within the second central hollow pulley guide support 36 of the second unified linkage 33, as seen in FIG. 4. The third pulley 90 is mounted for rotation about a horizontal axis perpendicular to the central plane of the wall partition 10 and is centered relative thereto. The cable 84 extends from the third pulley 90 back up to a fourth pulley 92 mounted to the unified hanging structure 29 adjacent the end of the central spacer 28 opposite the second pulley 86 between the angled supports 88. According to the illustrated embodiment, the fourth pulley 92 is disposed in line with the second pulley 86. However, it is noted that the second and fourth pulleys 86 and 92 could be offset and disposed on opposed sides of the central plane of the wall partition 10. The cable 84 extends over the fourth pulley 92 down to the bottom linkage 42 where it is fixed. The bottom portion of the cable 84 extends through a hollow stabilizer rod 94 extending vertically upwardly from one end of the bottom linkage 42. The terminal bottom end of the cable 84 is attached to the a ring-shaped head 96 of a horizontal threaded rod 98 threadably engaged with a securing member 100 fixed to the bottom linkage 42. As seen in FIG. 2, the cable 84 can passed on a cable thimble 102 mounted to the bottom linkage 42 to prevent the cable 84 from chafing.

Figure 2:
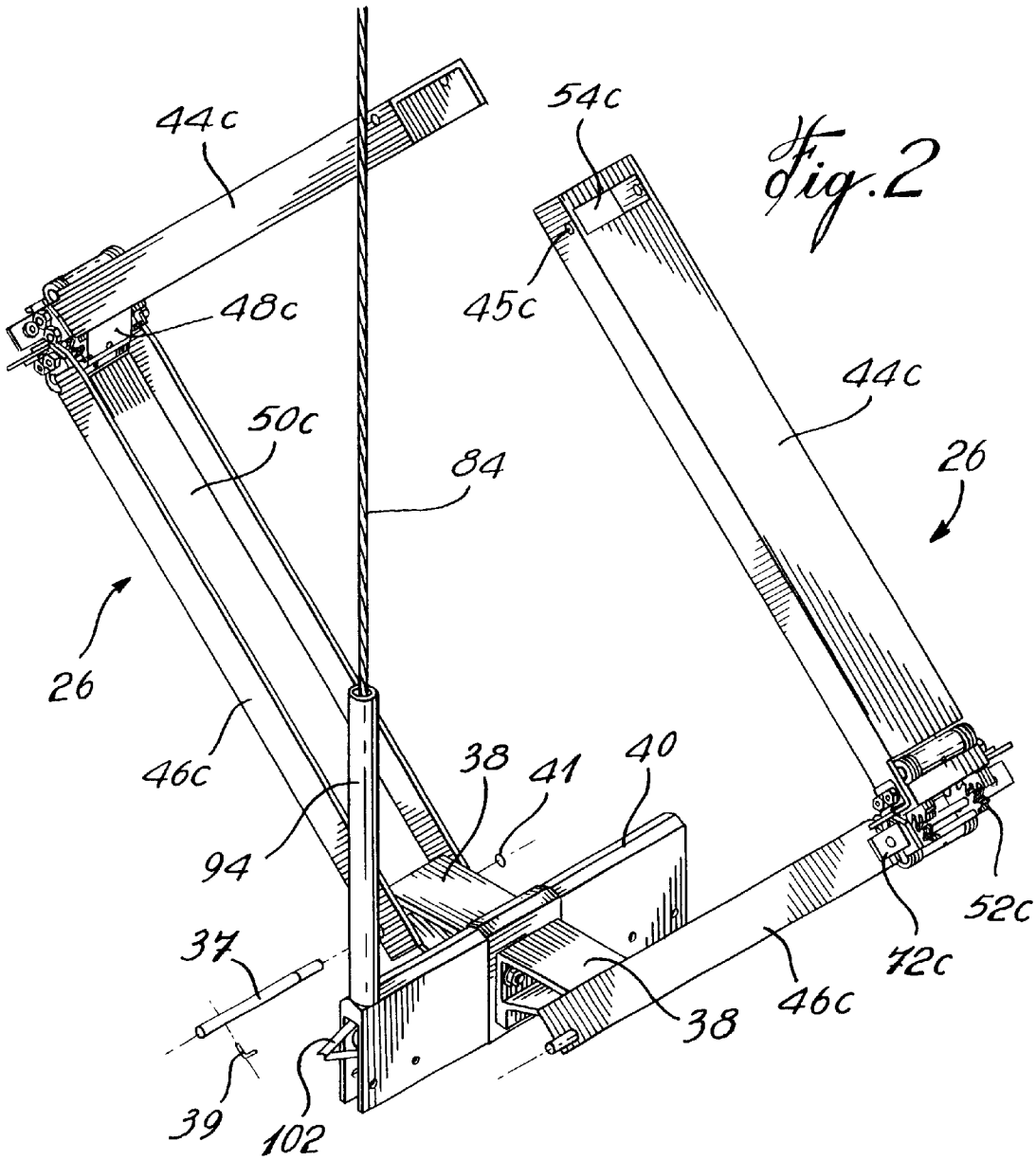
FIG. 2 is an enlarged perspective view of a pair of opposed bottom folding arms of the vertically folding wall partition of FIG. 1.

As seen in FIG. 1, the second and fourth pulleys 86 and 92 can be each provided with a hanger cable guide 104 to ensure proper positioning of the cable 84 relative to the pulleys.

Figure 5A:
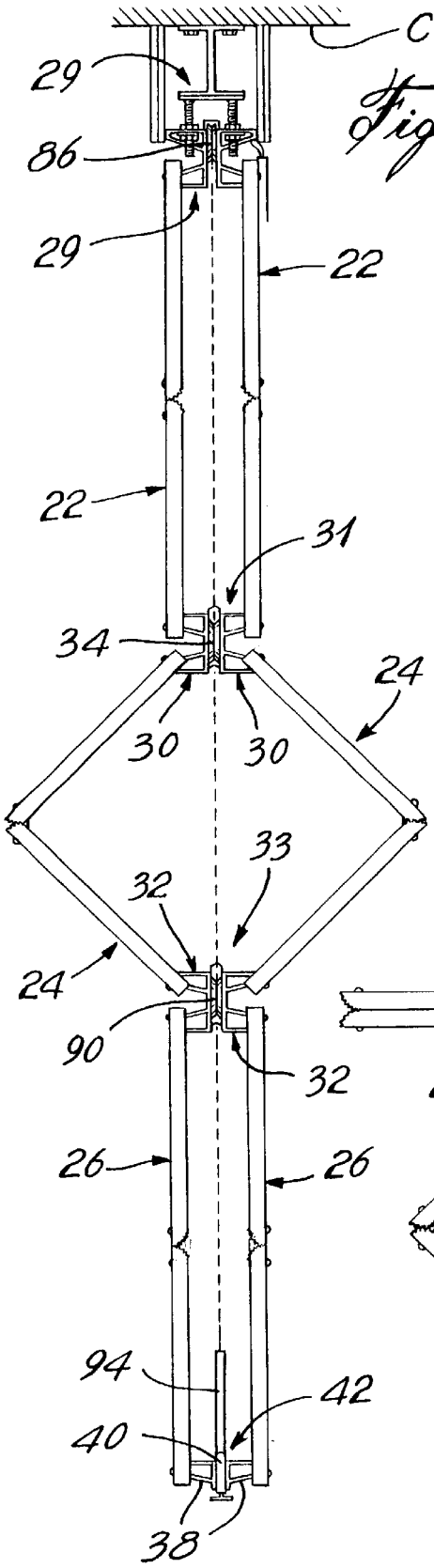
FIGS. 5*a* to 5*c* are schematic end elevational views of the vertically folding wall system showing the folding sequence thereof.
Figure 5B:
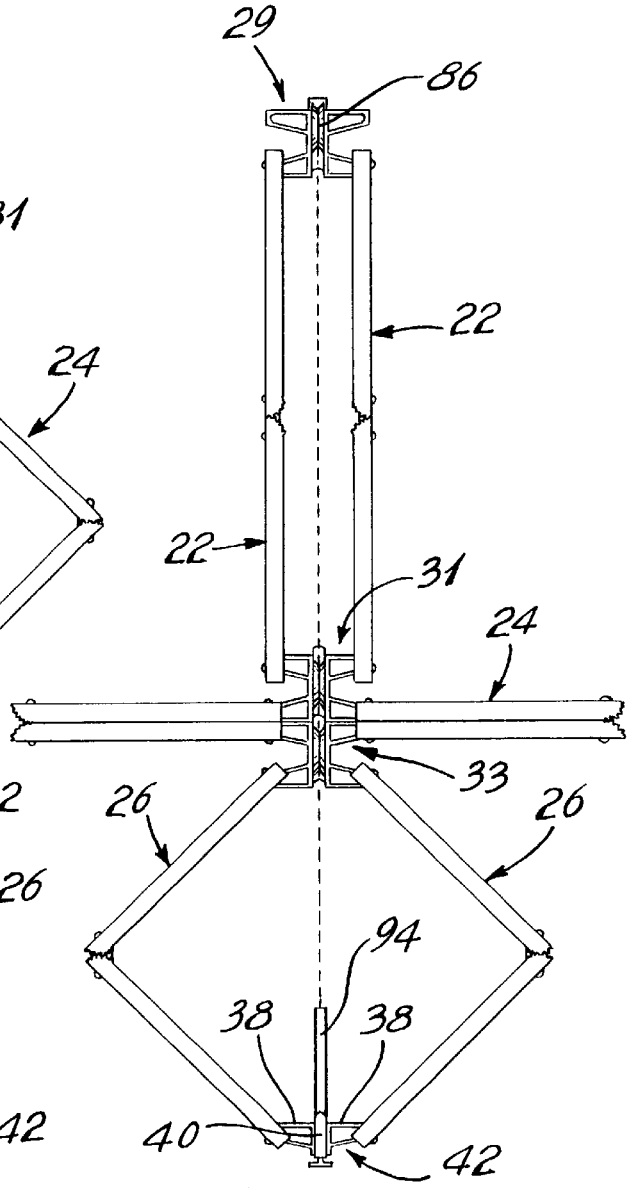
Figure 5C:
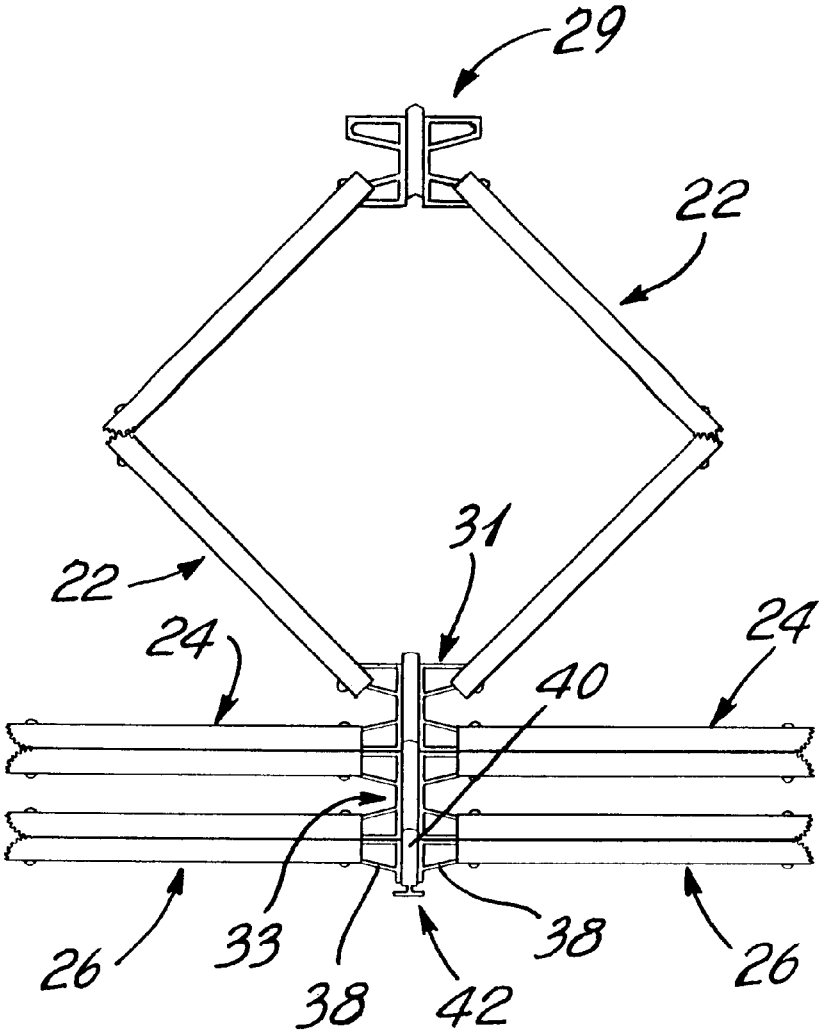

Referring now to FIGS. 5*a* to 5*c*, the sequential folding and unfolding operations of the wall partition 10 will be described. When it is desired to move the wall partition 10 from the deployed, unfolded straight, wall-forming position thereof to the retracted raised, folded position thereof, the motor (not shown) is activated so that the cables 84, one per skeleton framework 12, will be simultaneously and equally drawn. As seen in FIG. 5*a*, for each skeleton framework 12, the third pulley 90 will first be displaced vertically upwardly, thereby causing the intermediate arms 24 to fold outwardly away from the plane of the wall partition 10. This is because the tension in each cable 84 required to lift the third pulley 90 and the load attached thereto is smaller than the tension required to lift the bottom linkage 42 and associated load. Indeed, the folding sequence of the wall partition 10 is governed by cable tension. The cable tension increases with each subsequent fold. Once the third pulley 90 has been displaced up to the first unified linkage 31 so as to completely collapse the intermediate arms 24 in a surface-to-surface stacked relationship, the bottom linkage 42 starts to move upwards in response to the pulling action of the cable 84, as shown in FIG. 5*b*. This causes the bottom arms 26 to fold outwardly away from the plane of the wall partition 10. As soon as the bottom linkage has reached the second linkage 33 and that the bottom arms 26 are completely collapsed, then the top arms 22 start to fold due to the vertical movement induced to the first linkage 31 by the pushing action of the bottom linkage 42 and the second linkage 33 which are being drawn upwardly by the cable 84, as seen in FIG. 5*c*. The top, intermediate and bottom arms 22, 24 and 26 are unfolded in the inverse sequence. Thus, the top arms 22 are first deployed, followed by the bottom arms 26 and the intermediate arms 24.

Such a sequential folding contributes to render the operation of the wall partition 10 safer in that it prevents the bottom panels 18 of the wall partition 10 to come in contact with object or persons standing next thereto.

Tilt restrainers, one of which is shown in FIG. 4 at 105, are provided on either side of the first and second linkages 31 to ensure that the same are lifted in a stable manner. The tilt restrainer 105 includes a pair of identical rollers 111 freely mounted for rotation on respective idle axles 113. The cable 84 extends between the rollers 111 so as to engage the periphery thereof, thereby preventing the cable 84 from being offset with respect to the central plane of the vertically folding wall partition 10.

As seen in FIGS. 7 to 10, a universal sealing member 106 can be used either as an end seal (FIGS. 7 and 10) or a hinge seal (FIGS. 8 and 9) to provide acoustical insulation. The sealing member 106 includes a resilient piece of material 108 having first and second opposed longitudinal surfaces 110 and 112. Laterally spaced-apart hooked sides portions 114 and 116 extend integrally inwardly along opposed longitudinal side edges of the resilient piece of material 108 at an acute angle to the first longitudinal surface 110. A longitudinal ridge 118 extends from the first longitudinal surface adjacent each hooked side portion 114, 116.

Figure 7:
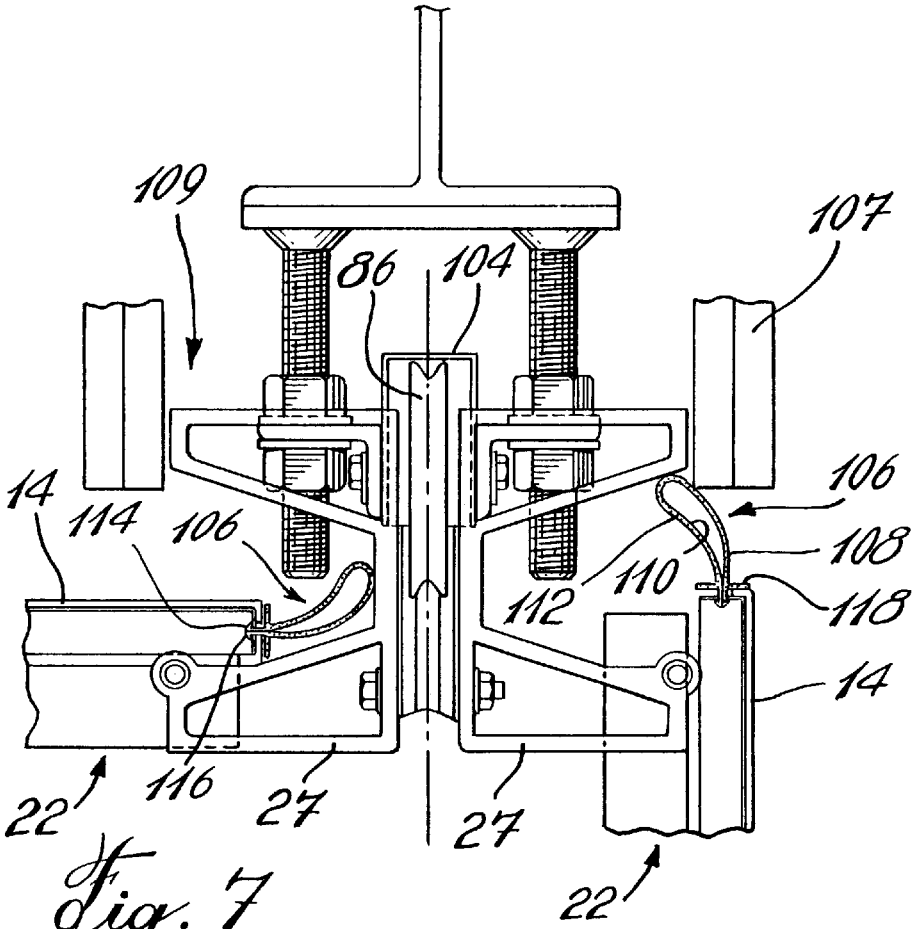
FIG. 7 is a fragmentary end elevational view of a top end portion of the vertically folding wall partition illustrating a top end seal arrangement thereof.
Figure 10:
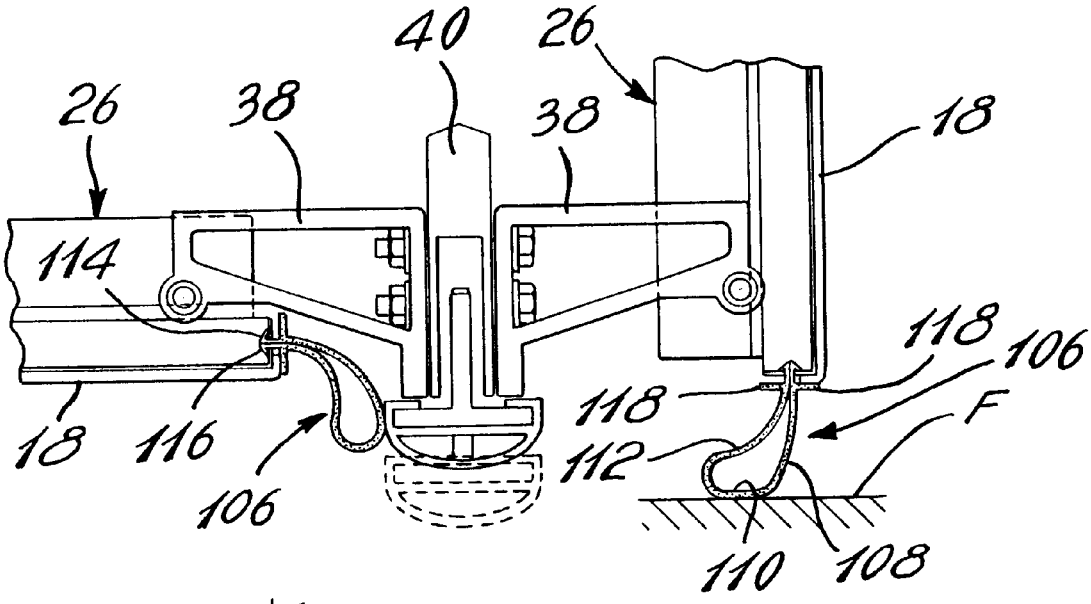
FIG. 10 is a fragmentary end elevational view of a bottom end portion of the vertically folding wall partition illustrating a bottom end seal arrangement thereof.

As seen in FIGS. 7 and 10, when it is desired to use the sealing member 106 as an end seal, one has simply to fold the resilient piece of material 108 so as to bring the opposed longitudinal side edges of the second longitudinal surface together, thereby placing the hooked side portions 114 and 116 in opposed surface-to-surface relationship. In this position, the hooked side portions 114 and 116 form a resilient pointed end which can be inserted under compression into a longitudinal cavity defined in respective distal ends of the top and bottom arms 22 and 26. The free distal end of the sealing member 106 disposed at the top of the wall partition will cooperate with the side wall 107 of a storage well 109 formed in the ceiling of the building to seal the uppermost end of the wall partition 10 when the top vertically foldable arms 22 are unfolded. Similarly, the sealing member 106 disposed at the bottom of the wall partition 10 will cooperate with the floor F to seal the bottom end of the wall partition 10 when in a deployed wall forming position thereof.

Figure 8:
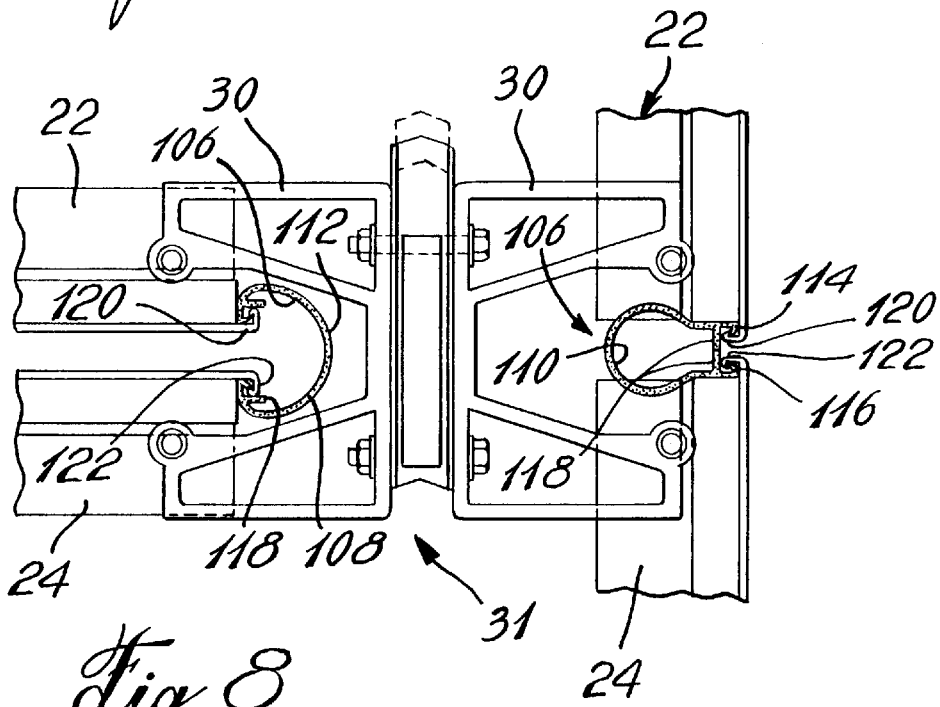
FIGS. 8 and 9 are fragmentary end elevational views of the vertically folding wall partition illustrating a hinge seal forming part of the wall partition.
Figure 9:
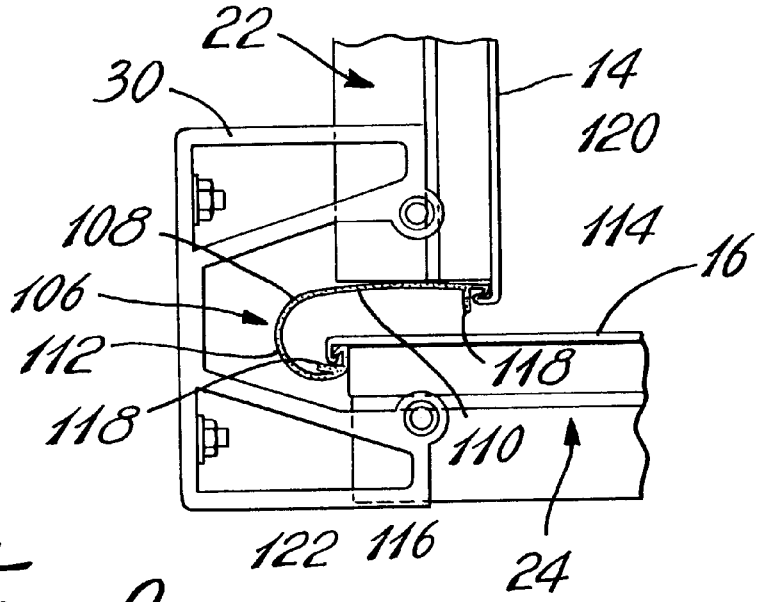

When the sealing member 106 is used as an intermediate or hinge seal, for instance, between the top vertically foldable arm 22 and the intermediate vertically foldable arm 24, as seen in FIGS. 8 and 9, the hooked side portion 114 is hooked in a complementary hook retaining cavity 120 defined in the lowermost top panel 14 and the hooked side portion 116 is similarly hooked in a complementary hook receiving cavity 122 defined in the uppermost intermediate panel 16. When sealing member 106 is so installed, the first longitudinal side forms the outer surface of the seal. As seen in FIG. 8, when the top and intermediate vertically foldable arms 22 and 24 extend in a same plane, the ridges 118 are abutted one onto the other so as to form a continues sealing barrier immediately adjacent the top and intermediate panels 14 and 16. The hooked side portions 114 and 116 advantageously provide for quick connection and disconnection of the sealing member 106.

It is noted that a limit switch (not shown) can be associated with the bottom end seal of the vertically folding wall partition 10 for sensing and controlling the operation of the motor used to move the wall partition 10 between the contracted and deployed positions thereof.

It is also understood that more than one panel can be provided per horizontal row of panels. Finally, although the present invention has been described with three vertically foldable arms 22, 24 and 26 per set 20, it is understood that more or less than three vertically foldable arms per set could be provided as well.

What is claimed is:

1. A vertically folding wall partition comprising a vertical series of similar pairs of panel assemblies, said vertical series including an uppermost panel assembly pivotally connected to an overhead support structure for rotation about a horizontal axis, each pair of adjacent panel assemblies in said vertical series being pivotally connected by a horizontal joint for allowing relative pivotal movement therebetween, each panel assembly including top and bottom panels pivotally related to one another at opposed horizontal edges thereof for pivotal movement between an unfolded position in which said top and bottom panels extend substantially in a common vertical plane and a folded position in which said top and bottom panels extend laterally outwardly of said common vertical plane in an opposed surface-to-surface stacked relationship; a moving mechanism for displacing said vertically folding wall partition between a retracted raised, storage position and a deployed, unfolded, wall-forming position, said moving mechanism engaging at least a selected one of said joints and a bottom end of a lowermost panel assembly of said vertical series to successively fold said panel assemblies in a folding sequence starting with a first panel assembly located immediately above said at least one selected joint.

2. A vertically folding wall partition as defined in claim 1, wherein said moving mechanism includes a first lifting arrangement operable to displace said at least one selected joint vertically upwardly to cause said first panel assembly to fold independently of said lowermost panel assembly, and a second lifting arrangement operable to displace said bottom end of said lowermost panel assembly vertically upwardly to cause the same to fold once said first panel assembly has been displaced to said folded position thereof.

3. A vertically folding wall partition as defined in claim 1, wherein said bottom end of said lowermost panel assembly is freely and independently movable in a vertical direction with respect to said joints.

4. A vertically folding wall partition as defined in claim 2, wherein said first and second lifting arrangements include a common lifting cable, and wherein said first and lowermost panel assemblies respectively fold at first and second cable tensions, said first cable tension being less than said second cable tension.

5. A vertically folding wall partition as defined in claim 4, wherein said first lifting arrangement includes cable guide means fixed to said selected joint for vertical movement therewith, and wherein said common lifting cable extends from said overhead structure downwardly through said cable guide means, back up to said overhead structure and down to said bottom end of said lowermost panel assembly where said common lifting cable is fixed.

6. A vertically folding wall partition as defined in claim 5, wherein said cable guide means include a movable pulley mounted to said selected joint, and wherein said common lifting cable extends over a first pulley fixed to said overhead structure down and around said movable pulley and then back up and over a second pulley fixed to said overhead structure.

7. A vertically folding wall partition as defined in claim 4, wherein similar panel assemblies are similarly mounted to both sides of said joints at a same distance from a central plane of said vertically folding wall partition to form a double sided-wall partition, and wherein the lowermost panel assemblies on both sides of the central plane are pivotally mounted at respective bottom ends thereof to opposed sides of a common central bottom link.

8. A vertically folding wall partition as defined in claim 7, wherein each joint includes first and second links mounted on opposed sides of a central support adapted to support a cable guide means.

9. A vertically folding wall partition as defined in claim 8, wherein said first and second links define respective top and bottom pivot axis.

10. A vertically folding wall partition as defined in claim 2, wherein each said panel assembly includes at least one panel supporting arm having first and second pivotally interconnected arm segments for respectively supporting the top and bottom panels of said panel assembly.

11. A vertically folding wall partition as defined in claim 10, wherein said top and bottom panels are each supported by at least two horizontally spaced-apart panel supporting arms.

12. A method of lifting a wall partition composed of a series of vertically foldable pairs of wall segments, said series having a lowermost and an uppermost pair of wall segments, comprising the steps of: lifting said lowermost pair by folding said selected pair of wall segments from an extended position to a collapsed position thereof, wherein said selected pair is the first pair folded when the wall partition is lifted and is folded by applying a lifting force at a joint between said selected pair and an adjacent pair of foldable wall segments depending therefrom; and subsequently folding said lowermost pair of wall segments to a collapsed position thereof.

* * * * *